US009588453B2

(12) United States Patent
Sawamoto et al.

(10) Patent No.: US 9,588,453 B2
(45) Date of Patent: Mar. 7, 2017

(54) RESIN-FILLED FERRITE CARRIER FOR ELECTROPHOTOGRAPHIC DEVELOPER AND ELECTROPHOTOGRAPHIC DEVELOPER USING THE FERRITE CARRIER

(71) Applicant: POWDERTECH CO., LTD., Kashiwa-shi, Chiba (JP)

(72) Inventors: Hiroki Sawamoto, Kashiwa (JP); Takao Sugiura, Kashiwa (JP)

(73) Assignee: POWDERTECH CO., LTD., Kashiwa-Shi, Chiba (JP)

( * ) Notice: Subject to any disclaimer, the term of this patent is extended or adjusted under 35 U.S.C. 154(b) by 0 days.

(21) Appl. No.: 14/673,557

(22) Filed: Mar. 30, 2015

(65) Prior Publication Data

US 2015/0277255 A1 Oct. 1, 2015

(30) Foreign Application Priority Data

Mar. 31, 2014 (JP) ..... 2014-074121

(51) Int. Cl.

| | |
|---|---|
| ***G03G 9/113*** | (2006.01) |
| ***G03G 9/10*** | (2006.01) |
| ***G03G 9/107*** | (2006.01) |

(52) U.S. Cl.

CPC ..... *G03G 9/10* (2013.01); *G03G 9/1075* (2013.01); *G03G 9/113* (2013.01); *G03G 9/1131* (2013.01); *G03G 9/1136* (2013.01); *G03G 9/1138* (2013.01)

(58) Field of Classification Search

CPC .... G03G 9/1075; G03G 9/113; G03G 9/1136; G03G 9/1137; G03G 9/1138; G03G 9/1133

See application file for complete search history.

(56) References Cited

U.S. PATENT DOCUMENTS

| | | | | |
|---|---|---|---|---|
| 2006/0269862 | A1 | 11/2006 | Kobayashi et al. | |
| 2007/0048649 | A1 | 3/2007 | Kobayashi et al. | |
| 2008/0199800 | A1* | 8/2008 | Kobayashi ..... | G03G 9/10 430/111.31 |
| 2008/0241726 | A1 | 10/2008 | Kobayashi et al. | |
| 2009/0176170 | A1 | 7/2009 | Sugiura et al. | |

FOREIGN PATENT DOCUMENTS

| | | | | |
|---|---|---|---|---|
| EP | 1962143 | A1 | 8/2008 | |
| EP | 1975732 | A2 | 10/2008 | |
| JP | H05-040367 | | 2/1993 | |
| JP | 2006-337579 | | 12/2006 | |
| JP | 2007-057943 | | 3/2007 | |
| JP | 2008-203476 | | 9/2008 | |
| JP | 2008-242348 | | 10/2008 | |
| JP | 2009-086093 | | 4/2009 | |
| JP | 2009-175666 | | 8/2009 | |
| JP | 2012-215858 | * | 11/2012 | ..... G03G 9/113 |
| JP | 2012-215875 | * | 11/2012 | ..... G03G 9/107 |

OTHER PUBLICATIONS

Translation of JP 2012-215858 published Nov. 2012.*
Translation of JP 2012-215875 published Nov. 2012.*
Notifications of Reasons for Refusal for JP App No. 2014-074121 dated Jun. 17, 2015, 6 pgs.
Extended European Search Report for EP App No. 15161634.9 dated Jul. 14, 2015, 5 pgs.

* cited by examiner

*Primary Examiner* — Peter Vajda
(74) *Attorney, Agent, or Firm* — Procopio, Cory, Hargreaves & Savitch LLP

(57) ABSTRACT

There is provided a resin-filled ferrite carrier for an electrophotographic developer, in which a void of a porous ferrite particle used as a ferrite carrier core material is filled with silicone resin, wherein a true specific gravity (Y) of the porous ferrite particle filled with the silicone resin and a Si/Fe value (X) measured by fluorescent X-ray elemental analysis satisfy the following inequality (1):

$$-350X \leq Y - 4.83 \leq -100X \quad (1).$$

6 Claims, No Drawings

RESIN-FILLED FERRITE CARRIER FOR ELECTROPHOTOGRAPHIC DEVELOPER AND ELECTROPHOTOGRAPHIC DEVELOPER USING THE FERRITE CARRIER

CROSS-REFERENCE TO RELATED APPLICATION

This application claims priority from Japanese Patent Application No. 2014-074121, filed on Mar. 31, 2014, the entire subject matter of which is incorporated herein by reference.

TECHNICAL FIELD

The present invention relates to a resin-filled ferrite carrier core material and a ferrite carrier for an electrophotographic developer used in a copying machine, a printer, etc., ensuring that the true density is light, the durability is excellent by virtue of having a high carrier strength, the rise of charging is good, and a charge variation is not caused during endurance printing; and an electrophotographic developer using the ferrite carrier.

BACKGROUND ART

An electrophotographic developing method is a method of developing an electrostatic latent image formed on a photosensitive body by adhering thereto a toner particle in a developer, and the developer used in this method is classified into a two-component developer composed of a toner particle and a carrier particle, and a one-component developer using only a toner particle.

As the developing method using, out of these developers, a two-component developer composed of a toner particle and a carrier particle, a cascade method, etc. have long been employed, but a magnetic brush method using a magnet roll is currently the mainstream.

In a two-component developer, the carrier particle is a carrier substance which is stirred together with a toner particle in a development box filled with the developer to impart a desired charge to the toner particle and furthermore, transports the charged toner particle to the surface of a photoreceptor to form a toner image on the photoreceptor. A carrier particle remaining on a magnet-holding development roll is again returned to the development box from the development roll, mixed/stirred with a fresh toner particle, and used repeatedly for a given period of time.

In a two-component developer, unlike a one-component developer, the carrier particle is mixed/stirred with a toner particle to exert a function of charging the toner particle and transporting the toner particle and has good controllability when designing a developer. Therefore, the two-component developer is suitable, e.g., for a full-color development apparatus requiring high image quality, or an apparatus of performing high-speed printing, in which reliability and durability in image preservation are required.

In a two-component developer used in this way, it is necessary that image characteristics such as image density, fogging, white spot, gradation and resolution show predetermined values from the initial stage and moreover, these characteristics are stably maintained with no variation during endurance printing. In order to stably maintain these characteristics, the properties of the carrier particle contained in the two-component developer must be stable.

As the carrier particle forming a two-component developer, various iron powder carriers, ferrite carriers, resin-coated ferrite carriers, magnetic powder-dispersed resin carriers, etc. have been conventionally used.

With the recent progress of office networking, the age of monofunctional copier evolves into the age of multifunctional copier, and the service system is also shifted from the age of system where a contracted service man performs periodic maintenance inclusive of replacement of a developer, etc., to the age of maintenance-free system, as a result, the market demand for a further longer life of the developer is more increasing.

Under these circumstances, in Patent Document 1 (JP-A-H5-40367), etc., magnetic powder-dispersed carriers containing a resin having dispersed therein fine magnetic microparticles have been proposed with the aim to reduce the weight of the carrier particle and extend the developer life.

Such a magnetic powder-dispersed carrier can reduce the true density by decreasing the amount of the magnetic microparticle and in turn, can reduce the stress due to stirring, so that abrasion or separation of the coating can be prevented and stable image properties can be obtained over a long period of time.

However, in the magnetic powder-dispersed carrier, a magnetic microparticle is hardened with a binder resin, and there may arise a problem that a magnetic microparticle is detached due to a stirring stress or an impact in a developing machine or the carrier particle itself is broken, may be because the mechanical strength is poor compared with the conventionally employed iron powder carrier or ferrite carrier. The detached magnetic microparticle or the broken carrier particle attaches to a photoreceptor and gives rise to generation of an image defect.

Furthermore, the magnetic powder-dispersed carrier uses a fine magnetic microparticle and therefore, has a drawback that the residual magnetization and coercive force are increased and in turn, the flowability of the developer is deteriorated. In particular, when a magnetic brush is formed on a magnet roll, because of high residual magnetization and high coercive force, the ear of the magnetic brush becomes hard, and a high image quality can be hardly obtained. In addition, there is a problem that even when the carrier leaves the magnet roll, the carrier is not disaggregated from magnetic aggregation and fails in quickly mixing with a toner replenished and therefore, the rise of the charge amount is poor, causing an image defect such as toner dusting or fogging.

As a carrier to replace such a magnetic powder-dispersed carrier, a resin-filled ferrite carrier where a void in a ferrite carrier core material using a porous ferrite particle is filled with a resin, has been proposed.

Patent Document 2 (JP-A-2006-337579) has proposed a resin-filled ferrite carrier obtained by filling a ferrite carrier core material with a resin, where the void ratio is from 10 to 60%, and Patent Document 3 (JP-A-2007-57943) has proposed a resin-filled ferrite carrier having a sterically laminated structure.

These resin-filled ferrite carriers proposed by Patent Documents 2 and 3, etc. are advantageous in that the specific gravity is low to enable weight reduction, the durability is excellent, making it possible to extend the life, the strength is high compared with a magnetic powder-dispersed carrier and at the same time, the carrier is free from breakage, deformation and fusion due to heat or impact.

However, charge stability over a long period of time is required also for such a resin-filled ferrite carrier, and proposals therefor have been made. For example, Patent Document 4 (JP-A-2008-203476) describes a resin-filled ferrite carrier for an electrophotographic developer, obtained by filling a void of a porous ferrite core material with a silicone resin, wherein the average particle diameter is from 20 to 50 μm, (Si/Fe)×100 measured by fluorescent X-ray elemental analysis is from 2.0 to 7.0, the particle diameter is correlated with (Si/Fe)×100, and in the correlative relationship between [(Si/Fe)×100] and particle diameter, the gradient (a) of the correlation formula is $-0.50 \leq a \leq 0.15$. This resin-filled ferrite carrier is said to be advantageous in that so-called beads carry over is prevented and good charge amount stability is achieved, in addition to the above-described advantages of the resin-filled ferrite carrier.

Patent Document 5 (JP-A-2008-242348) describes a resin-filled ferrite carrier obtained by filling a void of a porous ferrite core material with a silicone resin, wherein the resin is a silicone resin having a softening point of 40° C. or more and being cured at a temperature not lower than the softening point and the filling amount of the resin is from 7 to 30 parts by weight per 100 parts by weight of the core material. This resin-filled ferrite carrier is said to be advantageous in that since the amount of a resin microparticle existing in the floating state without adhering to the porous ferrite core material is small, the developer produced comes to have stable charge characteristics and an image defect such as white spot is not caused, in addition to the above-described advantages of the resin-filled ferrite carrier.

Patent Document 6 (JP-A-2009-86093) describes a production method of a resin-filled carrier obtained by filling a porous ferrite core material with a resin, wherein a value obtained by multiplying the pore volume of a ferrite core material by the density of a filling resin is defined as a maximum filling amount (theoretical value) and the pore volume of the core material and the amount of the resin are set to afford a filling amount of 80 to 120% of the maximum filling amount. It is said that the resin-filled carrier obtained by this production method has a proper resin filling amount, allowing for no presence of a floating resin and in turn, leading to no generation of an image defect attributable to a failure in charging a toner or no generation of an image defect attributable to a low dielectric breakdown voltage, and at the same time, the carrier has high strength.

As described above, in Patent Document 4, Si/Fe is specified to determine the correlation with the average particle diameter, whereby the amount of a resin particle existing in the floating state is reduced and the charge stability, etc. are improved. In Patent Document 5, a specific silicone resin is used as the filling resin so as to stably obtain charge stability. In Patent Document 6, a value obtained by multiplying the pore volume of a core material by the density of a filling resin is defined as a maximum filling amount (theoretical value) and the pore volume of the core material and the amount of the resin are set to eliminate the presence of a floating resin.

In recent years, the pore volume of a porous ferrite particle used as a porous ferrite core material tends to be reduced. Because, not only the strength of the core material is increased and high durability is obtained, but also a decrease in the resin filling amount is afforded, which is economically advantageous. However, under such a circumstance involving reduction in the pore volume of a ferrite particle, it is difficult for the resin-filled ferrite carrier or the production method thereof described in Patent Documents 4 to 6 to afford a developer having good charge amount stability.

In addition, while the developer is required to have high durability and extend its life, a carrier having durability is also demanded and in turn, a weight-reduced carrier having a low specific gravity is demanded. Furthermore, the optimal specific gravity required of the carrier varies according to the system of the developing machine. In such a situation, a resin-filled carrier where only the true specific gravity can be arbitrarily designed while maintaining the characteristics of the resin-filled carrier is required. However, the resin-filled ferrite carrier or the production method thereof described in Patent Documents 4 to 6 cannot respond to such requirements.

SUMMARY

Accordingly, an object of the present invention is to provide a resin-filled ferrite carrier for an electrophotographic developer, ensuring that when used for a developer, the developer has high charge amount stability, despite a small pore volume of a porous ferrite particle used as a ferrite carrier core material, while maintaining the advantages of a resin-filled ferrite carrier, and moreover, the true specific gravity can be arbitrarily controlled; and an electrophotographic developer using the resin-filled ferrite carrier.

As a result of intensive studies, the present inventors have found that when a silicone resin is used as the filling resin and a certain correlation is established between the true specific gravity of a porous ferrite particle filled with a silicone resin (resin-filled ferrite carrier) and the Si/Fe value, the above-described object can be attained. The present invention has been accomplished based on this finding.

That is, the present invention provides a resin-filled ferrite carrier for an electrophotographic developer, in which a void of a porous ferrite particle used as a ferrite carrier core material are filled with silicone resin, and wherein a true specific gravity (Y) of the porous ferrite particle filled with the silicone resin and the Si/Fe value (X) measured by fluorescent X-ray elemental analysis satisfy the following inequality (1):

[Expression 1]

$$-350X \leq Y - 4.83 \leq -100X \quad (1)$$

In the resin-filled ferrite carrier for an electrophotographic developer of the present invention, it may be preferred that the porous ferrite particle has a pore volume from 15 to 100 $mm^3/g$ and a peak pore diameter from 0.2 to 1.5 μm.

In the resin-filled ferrite carrier for an electrophotographic developer of the present invention, it may be preferred that the silicone resin is a room temperature-curable methylsilicone resin and contains an organic titanium-based catalyst and an aminosilane coupling agent.

In the resin-filled ferrite carrier for an electrophotographic developer according to the present invention, a surface of the ferrite carrier may be preferably coated with an acrylic resin.

In addition, the present invention provides an electrophotographic developer having the above-described resin-filled ferrite carrier and a toner.

The electrophotographic developer according to the present invention may be used as a replenishment developer.

The resin-filled ferrite carrier for an electrophotographic developer according to the present invention has a low specific gravity, can be reduced in the weight, is excellent in durability, making it possible to achieve life extension, has a high strength compared with a magnetic powder-dispersed carrier, and is free from breakage, deformation and fusion due to heat or impact. Furthermore, in the resin-filled ferrite carrier for an electrophotographic developer according to the present invention, the correlation between the true specific gravity of a porous ferrite particle filled with a silicone resin (resin-filled ferrite carrier) and the amount of resin present in the surface is specified, whereby the developer produced can have high charge amount stability and the true specific gravity can be arbitrarily controlled.

DETAILED DESCRIPTION

Resin-Filled Ferrite Carrier for Electrophotographic Developer

In the resin-filled ferrite carrier for an electrophotographic developer according to the present invention, a void of a porous ferrite particle used as a ferrite carrier core material are filled with a silicone resin.

It may be preferred that the porous ferrite particle used as the resin-filled ferrite carrier core material for an electrophotographic developer according to the present invention has a pore volume from 15 to 100 $mm^3/g$ and a peak pore diameter from 0.2 to 1.5 μm.

If the porous volume of the porous ferrite particle is less than 15 $mm^3/g$, the porous ferrite particle cannot be filled with a sufficient amount of a resin and the weight cannot be reduced. If the pore volume of the porous ferrite particle exceeds 100 $mm^3/g$, the strength of the carrier cannot be maintained even when filled with a resin.

In the present invention, an appropriate pore volume can be selected from the above-described range of the pore volume to afford the desired true specific gravity. In order to obtain a resin-filled ferrite carrier having a small true specific gravity, a ferrite particle having a large pore volume is filled with a somewhat large amount of a resin, and in order to obtain a resin-filled ferrite carrier having a large true specific gravity, a ferrite particle having a small pore volume is filled with a somewhat small amount of a resin.

When the peak pore diameter of the porous ferrite particle is 0.2 μm or more, the surface unevenness of the core material is of an appropriate size, the contact area with a toner is then increased, and the triboelectric charging with a toner is performed efficiently, as a result, the charge rise characteristics are improved, despite a low specific gravity. If the peak pore diameter of the porous ferrite particle is less than 0.2 μm, such an effect is not obtained and since the carrier surface after filling becomes flat and smooth, a sufficient stress with a toner cannot be imparted to the carrier having a low specific gravity, leading to a poor rise of charging. If the peak pore diameter of the porous ferrite particle exceeds 1.5 μm, the resin-dwelling area becomes large relative to the surface area of the particle and therefore, aggregation between particles is likely to occur at the time of filling with the resin, as a result, many aggregate particles and irregularly shaped particles are present in the carrier particle after filling with the resin. Consequently, the carrier particle is disaggregated from aggregation of particles due to a stress during endurance printing, giving rise to charge variation. Furthermore, when a porous ferrite particle has a peak pore diameter in excess of 1.5 μm, the surface unevenness of the particle is large, in other words, the particle itself is ill-shaped, and since the strength is also poor, the carrier particle itself may be broken due to a stress during endurance printing, giving rise to charge variation. The peak pore diameter of the porous ferrite particle is more preferably from 0.4 to 1.2 μm and most preferably from 0.4 to 0.8 μm.

In this way, the pore volume and the peak pore diameter in the above-described ranges, whereby a weight-reduced resin-filled ferrite carrier having a small pore volume can be obtained without the troubles above.

[Pore Diameter and Pore Volume of Porous Ferrite Particle]

The pore diameter and pore volume of the porous ferrite particle were measured as follows. That is, the measurement was performed using mercury porosimeters Pascal 140 and Pascal 240 (manufactured by Thermo Fisher Scientific Inc.). As a dilatometer, CD3P (for powder) was used. A sample was put in a commercially available gelatin-made capsule having a plurality of opened holes, and the capsule was placed in the dilatometer. After deaeration in Pascal 140 and filling with mercury, a low-pressure region (from 0 to 400 kPa) was measured as 1st Run. Successively, deaeration and measurement of a low-pressure region (from 0 to 400 kPa) were again performed as 2nd Run. After the 2nd Run, the total weight of the dilatometer, mercury, capsule and sample was measured. Next, a high-pressure region (from 0.1 to 200 MPa) was measured in Pascal 240, and from the amount of mercury intruded, which was obtained in the measurement of the high-pressure region, the pore volume, pore diameter distribution and peak pore diameter of the porous ferrite particle were determined. When determining the pore diameter, the calculation was performed on the condition that the surface tension of mercury is 480 dyn/cm and the contact angle is 141.3°.

The composition of the porous ferrite particle preferably contains at least one member selected from Mn, Mg, Li, Ca, Sr, Cu and Zn. Considering the recent trend toward reduction of an environmental impact, including waste regulations, it is preferred not to contain heavy metals of Cu, Zn and Ni in excess of the unavoidable impurity (incidental impurity) level.

The resin-filled ferrite carrier for an electrophotographic developer according to the present invention is obtained by filling a void of the above-described porous ferrite particle as a ferrite carrier core material with a resin. The filling amount of the resin is preferably from 0.5 to 10 parts by weight per 100 parts by weight of the ferrite carrier core material. If the filling amount of the resin is less than 0.5 parts by weight, a resin-filled ferrite carrier with insufficient filling may result, and control of the charge amount by the resin coating becomes difficult. If the filling amount of the resin exceeds 10 parts by weight, an aggregate particle is readily generated at the time of filling, and charge variation is caused.

The resin to fill voids of the porous ferrite particle is a straight silicone resin or a modified silicone resin modified with a resin such as acrylic resin, styrene resin, polyester resin, epoxy resin, polyamide resin, polyamideimide resin, alkyd resin, urethane resin or fluororesin.

For the purpose of controlling the electric resistance, charge amount and charging rate of the carrier, an electrically conductive agent may be added to the filling resin. The electric resistance of the electrically conductive agent itself is low and therefore, when the amount added thereof is too large, an abrupt charge leakage is likely to occur. Accordingly, the amount added is from 0.25 to 20.0 wt %, preferably from 0.5 to 15.0 wt %, more preferably from 1.0 to 10.0 wt %, based on the solid content of the silicone resin. The electrically conductive agent includes an electrically conductive carbon, an oxide such as titanium oxide and tin oxide, and various organic electrically conductive agents.

In addition, a charge control agent may be incorporated into the silicone resin. Examples of the charge control agent include various charge control agents generally used for a toner, and various silane coupling agents. This is because when filled with a large amount of a silicone resin, the charge imparting ability sometimes decreases but this can be controlled by the addition of various charge control agents or silane coupling agents. The kind of the usable charge control agent or silane coupling agent is not particularly limited, but a charge control agent such as nigrosine dye, quaternary ammonium salt, organometallic complex and metal-containing monoazo dye, an aminosilane coupling agent, a fluorine-based silane coupling agent, etc. are preferred.

A room temperature-curable methylsilicone resin is preferably used as the silicone resin, and a resin containing an organic titanium-based catalyst and an aminosilane coupling agent is more preferred. Examples of the organic titanium-based catalyst include titanium diisopropoxy bis(ethyl acetoacetate), and examples of the aminosilane coupling agent include 3-aminopropyltriethoxysilane.

The volume average particle diameter ($D_{50}$) of the resin-filled ferrite carrier for an electrophotographic developer according to the present invention is preferably from 20 to 50 μm. Within this range, beads carry over is prevented, and a good image quality is obtained. If the average particle diameter is less than 20 μm, beads carry over may be disadvantageously caused. If the average particle diameter exceeds 50 μm, deterioration of the image quality due to reduction in the charge imparting ability may be disadvantageously caused.

[Volume Average Particle Diameter (Microtrac)]

This average particle diameter is measured as follows. That is, the average particle diameter is measured by means of Microtrac Particle Size Analyzer (model 9320-X100) manufactured by Nikkiso Co., Ltd. Water is used as the dispersion medium. After putting 10 g of a sample and 80 ml of water in a 100-ml beaker, a few drops of a dispersant (sodium hexametaphosphate) are added, and the resulting mixture is dispersed for 20 seconds by using an ultrasonic homogenizer (model UH-150, manufactured by SMT Co., Ltd.) and setting the output level to 4. Thereafter, bubbles formed on the surface of the beaker are removed, and the sample is charged into the apparatus.

In the resin-filled ferrite carrier for an electrophotographic developer of the present invention, the true specific gravity (Y) of the porous ferrite particle filled with the silicone resin and the Si/Fe value (X) measured by fluorescent X-ray elemental analysis satisfy the following inequality (1):

[Expression 2]

$$-350X \leq Y - 4.83 \leq -100X \quad (1)$$

Due to the configuration that the true specific gravity (Y) of the porous ferrite particle and the Si/Fe value (X) measured by fluorescent X-ray elemental analysis satisfy inequality (1), the above-described effects can be achieved, i.e., a developer obtained using the ferrite particle together with a carrier can have high charge stability, despite a small pore volume of the porous ferrite particle as a ferrite carrier core material, and moreover, the true specific gravity can be arbitrarily controlled. If inequality (1) is not satisfied, these effects are not obtained.

In the present invention, the reason why inequality (1) should be satisfied is as follows. For example, desired carrier characteristics are assumed to be obtained when a porous ferrite particle having a pore volume of 50 is filled with 50 of a resin. When the filling amount of the resin is merely increased or decreased with the intention to afford a light or heavy true specific gravity, the desired specific gravity may be obtained, but the desired carrier characteristics cannot be satisfied. In order to arbitrarily control the true specific gravity while satisfying the carrier characteristics, the pore volume of the porous ferrite particle must be taken into consideration. In the region of the pore volume specified in the present invention, an optimal resin filling amount is not strictly proportional to a pore volume. The optimal value of the Si/Fe cited as the indicator of a resin filling property varies according to the pore volume and therefore, a certain Si/Fe value cannot be used as the indicator in controlling the true specific gravity. For this reason, an indicator such as inequality (1) is required.

(Fluorescent X-Ray Elemental Analysis)

The fluorescent X-ray elemental analysis is a method of measuring the amount of an element existing near a depth of several μM from the carrier surface, and the amount of the resin existing in the vicinity of the carrier surface is evaluated by this analysis. As the measurement apparatus, ZSX100s manufactured by Rigaku Corp. was used. About 5 g of a sample was put in a powder sample vessel for use in vacuum (RS640, manufactured by Rigaku Corp.), the vessel was set in a sample holder, and Si and Fe were measured. Here, as the measurement conditions, an Si-Kα line as the measurement ray, a tube voltage of 50 kV, a tube current of 50 mA, PET as the dispersive crystal, and PC (proportional counter) as the detector were used for Si, and an Fe-Kα line as the measurement ray, a tube voltage of 50 kV, a tube current of 50 mA, LiF as the dispersive crystal, and SC (scintillation counter) as the detector were used for Fe.

The intensity ratio [(Si intensity/Fe intensity)×100] was calculated using respective fluorescent X-ray intensities obtained.

(True Specific Gravity)

The true specific gravity was measured by means of a picnometer in conformity with JIS R9301-2-1. The measurement was performed at a temperature of 25° C. by using methanol as the solvent.

The surface of the resin-filled ferrite carrier for an electrophotographic developer according to the present invention is preferably coated with an acrylic resin. The carrier characteristics, among others, the electrical characteristics including charging characteristics, are in many cases affected by the material existing in the carrier surface or the surface properties. Therefore, the desired carrier characteristics can be adjusted with good precision by coating the surface with an acrylic resin. The coating amount of the acrylic resin is preferably from 0.5 to 5.0 parts by weight per 100 parts by weight of the filled ferrite carrier (before resin coating).

For the same purpose as above, an electrically conductive agent or a charge control agent may be incorporated also into the acrylic resin as the coating resin. The kind and amount added of the electrically conductive agent or charge control agent are the same as those for the filling resin, i.e., the silicone resin.

<Production Method of Resin-Filled Ferrite Carrier for Electrophotographic Developer>

The production method of the resin-filled ferrite carrier for an electrophotographic developer according to the present invention is described below.

In producing a porous ferrite particle used as a ferrite carrier core material of the resin-filled ferrite carrier for an electrophotographic developer according to the present invention, appropriate amounts of raw materials are weighed and then pulverized/mixed by means of a ball mill, a vibration mill, etc. for 0.5 hours or more, preferably from 1 to 20 hours. The raw material is not particularly limited.

The pulverized material obtained in this way is pelletized by means of a pressure molding machine, etc. and then calcined at a temperature of 700 to 1,200° C.

After the calcining, the calcined material is further pulverized by means of a ball mill, a vibration mill, etc. and then subjected to fine pulverization by adding water and using a bead mill, etc. Thereafter, a dispersant, a binder, etc. are added, if desired, to adjust the viscosity, and the pulverized material is granulated by a spray drier to perform granulation. In the case of performing pulverization after calcining, the calcined material may be pulverized by adding water and using a wet ball mill, a wet vibration mill, etc.

The pulverizer such as ball mill, vibration mill and bead mill is not particularly limited, but in order to effectively and uniformly disperse the raw material, a microparticulate bead having a particle diameter of 1 mm or less is preferably employed as the media used. In addition, the degree of pulverization can be controlled by adjusting the diameter of the bead used, the composition or the pulverization time.

The granulated material obtained is then heated at 400 to 800° C. to remove an organic component added, such as dispersant and binder. If sintering is performed while a dispersant or a binder remains, the oxygen concentration in the sintering apparatus readily varies due to decomposition or oxidation of an organic component and since this greatly affects the magnetic characteristics, stable production is difficult. In addition, such an organic component gives rise to variation of the porosity control, i.e., the crystal growth of ferrite.

The granulated material obtained is then held at a temperature of 800 to 1,500° C. for 1 to 24 hours in an atmosphere having a controlled oxygen concentration to perform sintering. In this case, a rotary electric furnace, a batch electric furnace, a continuous electric furnace, etc. is used, and the oxygen concentration may also be controlled by introducing an inert gas such as nitrogen or a reducing gas such as hydrogen or carbon monoxide into the atmosphere at the time of sintering.

The sintered material obtained in this way is pulverized and classified. As the method for classification, the existing air classification, mesh filtration method, precipitation method or the like is used to adjust the particle size to a desired particle diameter.

Thereafter, an oxide coating treatment may be applied, if desired, by heating the surface at a low temperature to adjust the electric resistance. In the surface coating treatment, a heat treatment may be performed, for example, at 300 to 700° C. by using a general rotary electric furnace, batch-type electric furnace or the like. The thickness of the oxide coating formed by this treatment is preferably from 0.1 nm to 5 μm. If the thickness is less than 0.1 nm, the effect of the oxide coating layer is small, and if the thickness exceeds 5 μm, magnetization may be reduced or the resistance may become too high, disadvantageously making it difficult to obtain desired characteristics. Before the oxide coating treatment, reduction may be performed, if desired. In this way, a porous ferrite particle (ferrite carrier core material) having a predetermined pore volume and a predetermined peak pore diameter is prepared.

In order to control the pore volume or peak pore diameter of the porous ferrite particle, the production process must be adjusted as follows.

That is, the pore volume of the porous ferrite particle can be controlled primarily by the sintering temperature. The pore volume becomes small when the temperature is high, and the pore volume becomes large when the temperature is low. The peak pore diameter of the porous ferrite particle can be controlled primarily by the pulverization strength after calcining. The peak pore diameter becomes large when the pulverization weak, and the peak pore diameter becomes small when the pulverization is strong.

A void of a ferrite carrier core material composed of the thus-obtained porous particle is filled with a silicone resin. As the filling method, various methods may be employed. The method includes, for example, a dry method, a spray dry system using a fluidized bed, a rotary dry system, and a dip-and-dry method using a universal agitator, etc.

In the step of filling with a silicone resin, a void of the porous ferrite particle is preferably filled with a resin while mixing/stirring the porous ferrite particle and the silicone resin under reduced pressure. By filling the void with a silicone resin under reduced pressure, the void portion can be efficiently filled with the resin. The degree of pressure reduction is preferably from 10 to 700 mmHg. If the pressure exceeds 700 mmHg, the effect of pressure reduction is not obtained, whereas if the pressure is less than 10 mmHg, a resin solution is likely to boil in the filling step, and efficient filling cannot be achieved.

The ferrite particle after filled with a silicone resin is heated, if desired, by various systems to adhere the filling resin to the core material. The heating system may be either an external heating system or an internal heating system, and, for example, a fixed or fluidized electric furnace, a rotary electric furnace or a burner furnace may be used or baking with microwave may also be employed. The temperature varies depending on the silicone resin for filling but must be a temperature not lower than the melting point or glass transition point, and by raising the temperature to a temperature allowing for sufficient progress of curing, a resin-filled ferrite carrier resistant to an impact can be obtained.

As described above, after the porous ferrite particle is filled with a silicone resin, the surface is preferably coated with an acrylic resin. The carrier characteristics, among others, the electrical characteristics including charging characteristics, are in many cases affected by the material existing in the carrier surface or the surface properties. Therefore, the desired carrier characteristics can be adjusted with good precision by coating the surface with an acrylic resin. As the coating method, the coating may be performed by a known method, for example, a brush coating method, a dry method, a spray dry system using a fluidized bed, a rotary dry system, and a dip-and-dry method using a universal agitator. In order to improve the coverage ratio, the method using a fluidized bed is preferred. In the case where the acrylic resin coated is baked, the baking may be of either an external heating type or an internal heating type, and, for example, a fixed or fluidized electric furnace, a rotary electric furnace or a burner furnace may be used or baking with microwave may also be employed. The baking temperature varies depending on the acrylic resin used but must be a temperature not lower than the melting point or glass transition point and needs to be raised to a temperature at which curing sufficiently proceeds.

In the production method of such a resin-filled ferrite carrier, the production process must be adjusted as follows so that the true specific gravity (Y) of the porous ferrite particle filled with the silicone resin and the Si/Fe value (X) measured by fluorescent X-ray elemental analysis can satisfy inequality (1).

Specifically, one of important things is to increase or decrease the resin filling amount according to the pore volume of the porous ferrite particle, and by this operation, inequality (1) can be satisfied. It may be also important that when filling the porous ferrite particle with the silicone resin, the resin is heated and cured after passing through a step of filling the ferrite particle with the resin under reduced pressure, returning the pressure to atmospheric pressure to remove toluene, and applying an appropriate stirring stress for a fixed time to make the particle surface uniform. By this operation, the filling property on the surface of the ferrite particle filled with a resin becomes uniform and not only variation of Si/Fe is reduced but also the carrier characteristics can be controlled.

With regard to the characteristics when coating a resin on the resin-filled ferrite carrier, a combination of an optimal resin filling amount and an optimal resin coating amount is required. A combination of decrease in the resin filling amount and increase in the resin coating amount, or a reverse combination thereof, may succeed in adjusting the carrier current value, but the combination affects the charge characteristics. Specifically, in the case of a combination of a small resin filling amount and a large resin coating amount, since the proportion of the coating resin in the carrier surface becomes large, granulation occurs at the time of carrier production, leading to decrease in the yield, and spent is readily generated to cause reduction in the charging ability. On the contrary, in the case of a combination of a large resin filling amount and a small resin coating amount, since the ratio of the filling resin in the carrier surface becomes large, the rise of charging is poor, and the coat readily comes off during endurance printing to cause reduction in the charging ability. For these reasons, a balance must be achieved between the resin filling amount and the resin coating amount.

<Electrophotographic Developer>

The electrophotographic developer according to the present invention is described below.

The electrophotographic developer according to the present invention is composed of the above-described resin-filled ferrite carrier for an electrophotographic developer and a toner.

The toner particle constituting the electrophotographic developer of the present invention includes a pulverized toner particle produced by a pulverization method, and a polymerized toner particle produced by a polymerizing method. In the present invention, a toner particle obtained by either method can be used.

The pulverized toner particle can be obtained, for example, by sufficiently mixing a binder resin, a charge control agent and a coloring agent by a mixer such as Henschel mixer, then melt-kneading the mixture by a twin-screw extruder, etc., subjecting the extrudate to cooling, pulverization and classification, adding an external additive, and then mixing these by a mixer, etc.

The binder resin constituting the pulverized toner particle is not particularly limited but includes polystyrene, chloropolystyrene, a styrene-chlorostyrene copolymer, a styrene-acrylic acid ester copolymer, a styrene-methacrylic acid copolymer, a rosin-modified maleic acid resin, an epoxy resin, a polyester resin, a polyurethane resin, etc. These resins are used individually or as a mixture.

As the charge control agent, any charge control agent may be used. For example, the charge control agent for a positively chargeable toner includes a nigrosine-based dye, a quaternary ammonium salt, etc., and the charge control agent for a negatively chargeable toner includes a metal-containing monoazo dye, etc.

As the coloring agent (color material), conventionally known dyes and pigments can be used. For example, carbon black, Phthalocyanine Blue, Permanent Red, Chrome Yellow, and Phthalocyanine Green can be used. Furthermore, an external additive such as silica powder and titania may be added according to the toner particle so as to improve the flowability and aggregation resistance of the toner.

The polymerized toner particle is a toner particle produced by a known method such as suspension polymerization method, emulsion polymerization method, emulsion aggregation method, ester extension polymerization method and phase transition emulsification method. In the production of such a polymerized toner particle, for example, a coloring agent dispersion liquid obtained by dispersing a coloring agent in water by use of a surfactant, a polymerizable monomer, a surfactant and a polymerization initiator are mixed and stirred in an aqueous medium, thereby emulsifying and dispersing the polymerizable monomer in the aqueous medium, and after polymerizing the polymerizable monomer under stirring and mixing, a salting-out agent is added to salt out a polymer particle. The particle obtained by salting out is filtered, washed and dried, whereby a polymerized toner particle can be obtained. Thereafter, if desired, an external additive is added to the dried toner particle.

Furthermore, at the time of production of the polymerized toner particle, a fixability improving agent and a charge control agent may be blended, in addition to the polymerizable monomer, surfactant, polymerization initiator and coloring agent. By this blending, various characteristics of the polymerized toner particle obtained can be controlled and improved. In addition, a chain transfer agent may also be used so as to improve the dispersibility of the polymerizable monomer in the aqueous medium and at the same time, adjust the molecular weight of the polymer obtained.

The polymerizable monomer used in the production of the polymerized toner particle is not particularly limited but includes, for example, styrene and a derivative thereof, ethylenically unsaturated monoolefins such as ethylene and propylene, vinyl halides such as vinyl chloride, vinyl esters such as vinyl acetate, and $\alpha$-methylene aliphatic monocarboxylic acid esters such as methyl acrylate, ethyl acrylate, methyl methacrylate, ethyl methacrylate and 2-ethylhexyl methacrylate.

As the coloring agent (color material) used at the time of preparation of the polymerized toner particle, conventionally known dyes and pigments can be used. For example, carbon black, Phthalocyanine Blue, Permanent Red, Chrome Yellow and Phthalocyanine Green can be used. In addition, the surface of the coloring agent may be modified with a silane coupling agent, a titanium coupling agent, etc.

As the surfactant used in the production of the polymerized toner particle, an anionic surfactant, a cationic surfactant, an amphoteric surfactant, and a nonionic surfactant may be used.

The anionic surfactant includes a fatty acid salt such as sodium oleate and castor oil, an alkylsulfuric acid ester such as sodium laurylsulfate and ammonium laurylsulfate, an alkylbenzenesulfonate such as sodium dodecylbenzenesulfonate, an alkylnaphthalenesulfonate, an alkylphosphoric ester salt, a naphthalenesulfonic acid-formalin condensate, a polyoxyethylenealkylsulfuric ester salt, etc. The nonionic surfactant includes a polyoxyethylene alkyl ether, a polyoxyethylene fatty acid ester, a sorbitan fatty acid ester, a polyoxyethylene alkylamine, glycerin, a fatty acid ester, an oxyethylene-oxypropylene block polymer, etc. The cationic surfactant includes, for example, an alkylamine salt such as laurylamine acetate, and a quaternary ammonium salt such as lauryltrimethylammonium chloride and stearyltrimethylammonium chloride. The amphoteric surfactant includes an aminocarboxylate, an alkylamino acid, etc.

The surfactant above may be used usually in an amount of 0.01 to 10 wt % based on the polymerizable monomer. The amount of such a surfactant used affects the dispersion stability of the monomer and at the same time, affects the environmental dependency of the polymerized toner particle obtained, and therefore, use in the range above ensuring the dispersion stability of the monomer and not excessively affecting the environmental dependency of the polymerized toner particle is preferred.

In the production of the polymerized toner particle, a polymerization initiator is usually used. The polymerization initiator includes a water-soluble polymerization initiator and an oil-soluble polymerization initiator, and both can be used in the present invention. The water-soluble polymerization initiator that can be used in the present invention includes, for example, a persulfate such as potassium persulfate and ammonium persulfate, and a water-soluble peroxide compound. The oil-soluble polymerization initiator includes, for example, an azo compound such as azobisisobutyronitrile, and an oil-soluble peroxide compound.

In the case of using a chain transfer agent in the present invention, the chain transfer agent includes, for example, mercaptans such as octylmercaptan, dodecylmercaptan and tert-dodecylmercaptan, and carbon tetrabromide.

In the case where the polymerized toner particle used in the present invention contains a fixability improving agent, for example, a natural wax such as carnauba wax, and an olefinic wax such as polypropylene and polyethylene, may be used as the fixability improving agent.

In the case where the polymerized toner particle used in the present invention contains a charge control agent, the charge control agent used is not particularly limited, and a nigrosine-based dye, a quaternary ammonium salt, an organic metal complex, a metal-containing monoazo dye, etc. may be used.

The external additive used to enhance the flowability, etc. of the polymerized toner particle includes, for example, silica, titanium oxide, barium titanate, fluororesin microparticle, and acrylic resin microparticle. These additives may be used individually or in combination.

The salting-out agent used to separate the polymerized particle from the aqueous medium includes a metal salt such as magnesium sulfate, aluminum sulfate, barium chloride, magnesium chloride, calcium chloride and sodium chloride.

The average particle diameter of the toner particle produced as above is from 2 to 15 μm, preferably from 3 to 10 μm, and the polymerized toner particle is higher in the uniformity of particles than the pulverized toner particle. If the particle diameter of the toner particle is less than 2 μm, the charging ability decreases to readily cause fogging or toner dusting, and if the particle diameter exceeds 15 μm, deterioration of the image quality is caused.

An electrophotographic developer can be obtained by mixing the carrier and toner produced as above. The mixing ratio of the carrier and the toner, i.e., the toner concentration, is preferably set to from 3 to 15 wt %. If the toner concentration is less than 3 wt %, a desired image density can be hardly obtained, and if the toner concentration exceeds 15 wt %, toner dusting or fogging is likely to occur.

The developer obtained by mixing the carrier and toner obtained as above can be used as a developer for replenishment. In this case, the carrier and the toner are mixed in a ratio of, that is, are used in a mixing ratio of, from 2 to 50 parts by weight of toner per 1 part by weight of carrier.

The electrophotographic developer according to the present invention prepared as above can be used in a copying machine, a printer, FAX, a printing machine, etc., of a digital type employing a development system where an electrostatic latent image formed on a latent image holding member having an organic photoconductor layer is reversely developed with a magnetic brush of a two-component developer containing a toner and a carrier while applying a bias electric field. The electrophotographic developer can also be applied to a full-color machine, etc. using an alternating electric field, where when applying a development bias from a magnetic brush to an electrostatic latent image side, an AC bias is superimposed on a DC bias.

The present invention is specifically described below based on Examples and the like.

EXAMPLES

Example 1

Raw materials were weighed to afford 38 mol % of MnO, 11 mol % of MgO, 50.3 mol % of $Fe_2O_3$ and 0.7 mol % of SrO and pulverized for 4.5 hours by a dry media mill (vibration mill, stainless steel beads of ⅛ inch in diameter). The pulverized material obtained was formed into an about 1 mm-square pellet by a roller compactor. Trimanganese tetroxide, magnesium hydroxide and strontium carbonate were used as the MnO raw material, MgO raw material and SrO raw material, respectively. The pellet was sieved through a vibration sieve with an opening size of 3 mm to remove a coarse powder and then through a vibration sieve with an opening size of 0.5 mm to remove a fine powder, and heated at 1,080° C. for 3 hours in a rotary electric furnace to perform calcining.

The calcined material was then pulverized to an average particle diameter of about 4 μm by using a dry media mill (vibration mill, stainless steel beads of ⅛ inch in diameter) and after adding water, further pulverized for 10 hours by using a wet media mill (vertical bead mill, stainless steel beads of 1/16 inch in diameter). This slurry was measured for the particle diameter (primary particle diameter of pulverization) by Microtrac, as a result, $D_{50}$ was 1.5 μm. An appropriate amount of a dispersant was added to the resulting slurry, PVA (20% solution) as a binder was added in an amount of 0.2 wt % based on the solid content so as to obtain an appropriate pore volume, the slurry was then granulated by a spray drier and dried, the particle size of the obtained particle (granulated material) was adjusted, and thereafter, the particle was heated at 700° C. for 2 hours in a rotary electric furnace to remove an organic component such as dispersant and binder.

The particle obtained was held for 5 hours in an atmosphere having an oxygen gas concentration of 1.2 vol % at a sintering temperature of 1,065° C. in a tunnel-type electric furnace. At this time, the temperature rise rate and the temperature drop rate were set to 150° C./hour and 110° C./hour, respectively. Thereafter, the sintered material was cracked and classified to adjust the particle size, and a low magnetic particle was separated off by magnetic separation to obtain a porous ferrite particle (ferrite carrier core material). In this porous ferrite particle, the pore volume was 59 $mm^3/g$, the peak pore diameter was 0.64 μm, and the true specific gravity was 4.83.

To 24 parts by weight of a methylsilicone resin solution (4.8 parts by weight in terms of solid content, because the solution is a toluene solution having a resin concentration of 20%), titanium diisopropoxy bis(ethyl acetoacetate) as a catalyst was added in an amount of 25 wt % (3 wt % in terms of Ti atom) based on the resin solid content and thereafter, 3-aminopropyltriethoxysilane as an aminosilane coupling agent was added in an amount of 5 wt % based on the resin solid content, to obtain a filling resin solution.

The resulting resin solution was mixed/stirred with 100 parts by weight of the porous ferrite particle obtained above at 60° C. under reduced pressure of 6.7 kPa (about 50 mmHg) to impregnate and fill voids of the porous ferrite particle with the resin while evaporating toluene. The pressure in the vessel was returned to ordinary pressure and after almost completely removing toluene while continuing stirring under ordinary pressure, the residue was taken out of the filling apparatus and put in a vessel. The vessel was placed in an oven of a hot air heating type, and a heating treatment was performed at 220° C. for 1.5 hours.

Thereafter, the product was cooled to room temperature, and a ferrite particle with the resin being cured was taken out and disaggregated from aggregation of particles by using a vibrating sieve with an opening size of 200 M. The non-magnetic material was removed by means of a magnetic separator and then, coarse particles were removed by again using the vibrating sieve to obtain a ferrite particle filled with resin.

A solid acrylic resin (product name: BR-73, produced by Mitsubishi Rayon Co., Ltd.) was prepared, and 20 parts by weight of the acrylic resin was mixed with 80 parts by weight of toluene to dissolve the acrylic resin in toluene, whereby a resin solution was prepared. To this resin solution, carbon black (product name: Mogul L, produced by Cabot) as a conductivity control agent was added in an amount of 3 wt % based on the acrylic resin to obtain a coating resin solution.

The ferrite particle filled with the silicone resin was charged into a universal mixing and stirring machine, and the acrylic resin solution above was added to perform resin coating by immersion drying method. At this time, the coverage of the acrylic resin was set to 2 wt % based on the weight of the ferrite particle after filling with resin. The ferrite particle after the coating was heated at 145° C. for 2 hours and disaggregated from aggregation of particles by using a vibration sieve having an opening size of 200 M, and the non-magnetic material was removed by means of a magnetic separator. Thereafter, coarse particles were removed by again using the vibration sieve to obtain a resin-filled ferrite carrier with the surface being resin-coated.

Example 2

A ferrite particle filled with resin was obtained by performing the silicone resin filling in the same manner as in Example 1 except that the amount of the methylsilicone resin solution was changed to 27 parts by weight (5.4 parts by weight in terms of solid content, because the solution is a toluene solution having a resin concentration of 20%) per 100 parts by weight of the same porous ferrite particle as used in Example 1.

On this ferrite particle filled with resin, an acrylic resin in an amount of 1.8 wt % based on the weight of the ferrite particle after resin filling was coated in the same manner as in Example 1 to obtain a resin-filled ferrite carrier.

Example 3

A ferrite particle filled with resin was obtained by performing the silicone resin filling in the same manner as in Example 1 except that the amount of the methylsilicone resin solution was changed to 21 parts by weight (4.2 parts by weight in terms of solid content, because the solution is a toluene solution having a resin concentration of 20%) per 100 parts by weight of the same porous ferrite particle as used in Example 1.

On this ferrite particle filled with resin, an acrylic resin in an amount of 2.2 wt % based on the weight of the ferrite particle after resin filling was coated in the same manner as in Example 1 to obtain a resin-filled ferrite carrier.

Example 4

A porous ferrite particle (ferrite carrier core material) was obtained in the same manner as in Example 1 except that the sintering conditions were changed to a sintering temperature of 1,115° C. and an oxygen concentration of 1.5 vol %.

A ferrite particle filled with resin was obtained by performing the silicone resin filling in the same manner as in Example 1 except that the amount of the methylsilicone resin solution was changed to 17.5 parts by weight (3.5 parts by weight in terms of solid content, because the solution is a toluene solution having a resin concentration of 20%) per 100 parts by weight of the ferrite particle obtained above.

On this ferrite particle filled with resin, an acrylic resin in an amount of 2.0 wt % based on the weight of the ferrite particle after resin filling was coated in the same manner as in Example 1 to obtain a resin-filled ferrite carrier.

Example 5

A ferrite particle filled with resin was obtained by performing the silicone resin filling in the same manner as in Example 1 except that the amount of the methylsilicone resin solution was changed to 15 parts by weight (3.0 parts by weight in terms of solid content, because the solution is a toluene solution having a resin concentration of 20%) per 100 parts by weight of the same porous ferrite particle as used in Example 4.

On this ferrite particle filled with resin, an acrylic resin in an amount of 2.2 wt % based on the weight of the ferrite particle after resin filling was coated in the same manner as in Example 1 to obtain a resin-filled ferrite carrier.

Example 6

A porous ferrite particle (ferrite carrier core material) was obtained in the same manner as in Example 1 except that the sintering conditions were changed to a sintering temperature of 1,165° C. and an oxygen concentration of 2.2 vol %.

A ferrite particle filled with resin was obtained by performing the silicone resin filling in the same manner as in Example 1 except that the amount of the methylsilicone resin solution was changed to 7.0 parts by weight (1.4 parts by weight in terms of solid content, because the solution is a toluene solution having a resin concentration of 20%) per 100 parts by weight of the ferrite particle obtained above.

On this ferrite particle filled with resin, an acrylic resin in an amount of 1.8 wt % based on the weight of the ferrite particle after resin filling was coated in the same manner as in Example 1 to obtain a resin-filled ferrite carrier.

Example 7

A ferrite particle filled with resin was obtained by performing the silicone resin filling in the same manner as in Example 1 except that the amount of the methylsilicone resin solution was changed to 5 parts by weight (1.0 parts by weight in terms of solid content, because the solution is a toluene solution having a resin concentration of 20%) per 100 parts by weight of the same porous ferrite particle as used in Example 6.

On this ferrite particle filled with resin, an acrylic resin in an amount of 2.0 wt % based on the weight of the ferrite particle after resin filling was coated in the same manner as in Example 1 to obtain a resin-filled ferrite carrier.

Example 8

A porous ferrite particle (ferrite carrier core material) was obtained in the same manner as in Example 1 except that the sintering conditions were changed to a sintering temperature of 1,025° C. and an oxygen concentration of 0.8 vol %.

A ferrite particle filled with resin was obtained by performing the silicone resin filling in the same manner as in Example 1 except that the amount of the methylsilicone resin solution was changed to 26 parts by weight (5.2 parts by weight in terms of solid content, because the solution is a toluene solution having a resin concentration of 20%) per 100 parts by weight of the ferrite particle obtained above.

On this ferrite particle filled with resin, an acrylic resin in an amount of 2.2 wt % based on the weight of the ferrite particle after resin filling was coated in the same manner as in Example 1 to obtain a resin-filled ferrite carrier.

Comparative Example 1

A ferrite particle filled with resin was obtained by performing the silicone resin filling in the same manner as in Example 1 except that the amount of the methylsilicone resin solution was changed to 30 parts by weight (6 parts by weight in terms of solid content, because the solution is a toluene solution having a resin concentration of 20%) per 100 parts by weight of the same porous ferrite particle as used in Example 1.

On this ferrite particle filled with resin, an acrylic resin in an amount of 1.0 wt % based on the weight of the ferrite particle after resin filling was coated in the same manner as in Example 1 to obtain a resin-filled ferrite carrier.

Comparative Example 2

A ferrite particle filled with resin was obtained by performing the silicone resin filling in the same manner as in Example 1 except that the amount of the methylsilicone resin solution was changed to 18 parts by weight (3.6 parts by weight in terms of solid content, because the solution is a toluene solution having a resin concentration of 20%) per 100 parts by weight of the same porous ferrite particle as used in Example 1.

On this ferrite particle filled with resin, an acrylic resin in an amount of 3.0 wt % based on the weight of the ferrite particle after resin filling was coated in the same manner as in Example 1 to obtain a resin-filled ferrite carrier.

Comparative Example 3

A ferrite particle filled with resin was obtained by performing the silicone resin filling in the same manner as in Example 1 except that the amount of the methylsilicone resin solution was changed to 20 parts by weight (4.0 parts by weight in terms of solid content, because the solution is a toluene solution having a resin concentration of 20%) per 100 parts by weight of the same porous ferrite particle as used in Example 4.

On this ferrite particle filled with resin, an acrylic resin in an amount of 1.0 wt % based on the weight of the ferrite particle after resin filling was coated in the same manner as in Example 1 to obtain a resin-filled ferrite carrier.

Comparative Example 4

A ferrite particle filled with resin was obtained by performing the silicone resin filling in the same manner as in Example 1 except that the amount of the methylsilicone resin solution was changed to 12.5 parts by weight (2.5 parts by weight in terms of solid content, because the solution is a toluene solution having a resin concentration of 20%) per 100 parts by weight of the same porous ferrite particle as used in Example 4.

On this ferrite particle filled with resin, an acrylic resin in an amount of 2.5 wt % based on the weight of the ferrite particle after resin filling was coated in the same manner as in Example 1 to obtain a resin-filled ferrite carrier.

Comparative Example 5

A ferrite particle filled with resin was obtained by performing the silicone resin filling in the same manner as in Example 1 except that the amount of the methylsilicone resin solution was changed to 9 parts by weight (1.8 parts by weight in terms of solid content, because the solution is a toluene solution having a resin concentration of 20%) per 100 parts by weight of the same porous ferrite particle as used in Example 6.

On this ferrite particle filled with resin, an acrylic resin in an amount of 1.0 wt % based on the weight of the ferrite particle after resin filling was coated in the same manner as in Example 1 to obtain a resin-filled ferrite carrier.

Sintering conditions (sintering temperature and oxygen concentration) of each of the ferrite carrier core materials of Examples 1 to 8 and Comparative Example 1 to 5, the characteristics (pore volume, peak pore diameter and true specific gravity) of each of the ferrite carrier core materials, the silicone filling amount (amount of resin solution and amount in terms of solid content) of each of the resin-filled ferrite carriers, and the characteristics (Si/Fe and true gravity) of each of the resin-filled ferrite carriers are shown in Table 1. In addition, the resin coating amount (amount of resin solution and amount in terms of solid content) of each of the carriers and the characteristics (true specific gravity, current value, charge amount, charge rise rate, and charge amount change ratio) of each of resin-filled ferrite carriers are shown in Table 2.

In Table 2, the methods for measuring the current value, charge amount, rate of charge rising and rate of change in charge amount are as follows, and other measurement methods are as described above.

(Current Value)

In the measurement of the current value, 800 g of a sample was weighed, exposed to an environment of a temperature of 20 to 26° C. and a humidity of 50 to 60% RH for 15 minutes or more, and measured at an applied voltage of 500 V by using a current measurement apparatus where a magnet roller and an A1 stock tube are used as electrodes and arranged at a distance of 4.5 mm between each other.

(Charge Amount)

The charge amount was determined by measuring a mixture of a carrier and a toner by means of a suction-type charge amount measurement apparatus (Epping q/m-meter, manufactured by PES-Laboratoriumu). A commercially available negative toner used in a full-color printer (cyan toner for DocuPrint C3530, produced by Fuji Xerox Co., Ltd.; average particle diameter: about 5.8 μm) was used as the toner, and a developer in an amount of 10 g was prepared to have a toner concentration of 10 wt %. The developer prepared was put in a 50 cc glass bottle, and the glass bottle was housed and fixed in a cylindrical holder of 130 mm in diameter and 200 mm in height. The developer was stirred for 30 minutes on a Turbula mixer manufactured by Shinmaru Enterprises Corp., and the charge amount was measured using a 635M screen.

(Charge Rise Rate)

In the same manner as above, the developer was stirred for 3 minutes on a Turbula mixer, and the charge amount was measured using a 635M screen. From the value of charge amount after stirring for 3 minutes relative to the value of charge amount after 30 minutes above, the charge rise rate was calculated according to the following formula:

$$\text{Charge rise rate (\%)} = \frac{\text{Value of charge amount of carrier after stirring for 3 minutes}}{\text{Value of charge amount of carrier after stirring for 30 minutes}} \times 100 \quad \text{[Expression 3]}$$

The charge rise rate was evaluated as follows based on the numerical value obtained.

A: More than 90%

B: From 80 to 90%

C: Less than 80%

(Charge Amount Change Ratio)

The same commercially available negative toner (cyan toner for DocuPrint C3530, produced by Fuji Xerox Co., Ltd.; average particle diameter: about 5.8 μm) as the toner described above was used, a developer in an amount of 20 g was prepared to have a toner concentration of 10 wt % and put in a 50 cc glass bottle, and the glass bottle was stirred for 30 hours in a paint shaker manufactured by Asada Iron Works Co., Ltd. After the completion of stirring, the developer was take out, and the toner was suctioned using a 635M screen to take out only the carrier. The charge amount of the obtained carrier was measured by the above-described measurement method of charge amount and defined as the charge amount after forced stirring.

The charge amount change ratio was calculated according to the following formula:

$$\text{Charge amount change ratio (\%)} = \frac{\text{Value of charge amount of carrier subjected to forced stirring}}{\text{Value of charge amount of carrier not subjected to forced stirring}} \times 100 \quad \text{[Expression 4]}$$

The charge amount change ratio was evaluated as follows based on the numerical value obtained.

A: More than 90%

B: From 80 to 90%

C: Less than 80%

TABLE 1

| | Sintering Conditions of Ferrite Carrier Core Material | | Characteristics of Ferrite Carrier Core Material | | | Filling Amount of Silicone Resin of Resin-Filled Ferrite Carrier | | Characteristics of Resin-Filled Ferrite Carrier | |
|---|---|---|---|---|---|---|---|---|---|
| | Sintering Temperature (° C.) | Oxygen Concentration (vol %) | Pore Volume ($mm^3/g$) | Peak Pore Diameter (μm) | True Specific Gravity | Amount of Resin Solution (wt %) | (in terms of solid content) (wt %) | Si/Fe | True Specific Gravity |
| Example 1 | 1065 | 1.2 | 59 | 0.64 | 4.83 | 24 | 4.8 | 0.0035 | 4.27 |
| Example 2 | 1065 | 1.2 | 59 | 0.64 | 4.83 | 27 | 5.4 | 0.0048 | 4.26 |
| Example 3 | 1065 | 1.2 | 59 | 0.64 | 4.83 | 21 | 4.2 | 0.0019 | 4.33 |
| Example 4 | 1115 | 1.5 | 37 | 0.45 | 4.83 | 17.5 | 3.5 | 0.0032 | 4.41 |
| Example 5 | 1115 | 1.5 | 37 | 0.45 | 4.83 | 15 | 3.0 | 0.0015 | 4.47 |
| Example 6 | 1165 | 2.2 | 19 | 0.22 | 4.83 | 7 | 1.4 | 0.0016 | 4.60 |
| Example 7 | 1165 | 2.2 | 19 | 0.22 | 4.83 | 5 | 1.0 | 0.0007 | 4.64 |
| Example 8 | 1025 | 0.8 | 74 | 0.81 | 4.83 | 26 | 5.2 | 0.0025 | 4.15 |
| Comparative Example 1 | 1065 | 1.2 | 59 | 0.64 | 4.83 | 30 | 6.0 | 0.0070 | 4.18 |
| Comparative Example 2 | 1065 | 1.2 | 59 | 0.64 | 4.83 | 18 | 3.6 | 0.0010 | 4.40 |
| Comparative Example 3 | 1115 | 1.5 | 37 | 0.45 | 4.83 | 20 | 4.0 | 0.0048 | 4.37 |
| Comparative Example 4 | 1115 | 1.5 | 37 | 0.45 | 4.83 | 12.5 | 2.5 | 0.0007 | 4.52 |
| Comparative Example 5 | 1165 | 2.2 | 19 | 0.22 | 4.83 | 9 | 1.8 | 0.0033 | 4.55 |

TABLE 2

| | Resin Coating Amount of Carrier | | Characteristics of Resin-Coated Resin-Filled Ferrite Carrier | | | | |
|---|---|---|---|---|---|---|---|
| | Amount of Resin Solution (wt %) | (in terms of solid content) (wt %) | True Specific Gravity | Current Value (μA) | Charge Amount (μC) | Charge Rise Rate (%) | Charge Amount Change Ratio (%) |
| Example 1 | 10 | 2.0 | 4.04 | 17.5 | 30.2 | 93 | 96 |
| Example 2 | 9 | 1.8 | 4.03 | 10.1 | 29.1 | 91 | 96 |
| Example 3 | 11 | 2.2 | 4.07 | 14.6 | 28.8 | 92 | 94 |
| Example 4 | 10 | 2.0 | 4.16 | 11.0 | 29.5 | 92 | 95 |
| Example 5 | 11 | 2.2 | 4.21 | 12.5 | 31.8 | 94 | 93 |
| Example 6 | 9 | 1.8 | 4.27 | 14.6 | 27.9 | 90 | 97 |
| Example 7 | 10 | 2.0 | 4.36 | 11.8 | 28.7 | 92 | 94 |
| Example 8 | 11 | 2.2 | 3.86 | 14.6 | 29.9 | 93 | 95 |
| Comparative Example 1 | 5 | 1.0 | 4.08 | 11.8 | 29.5 | 79 | 85 |
| Comparative Example 2 | 15 | 3.0 | 4.04 | 12.5 | 30.9 | 95 | 77 |
| Comparative Example 3 | 5 | 1.0 | 4.25 | 11.2 | 27.4 | 80 | 83 |
| Comparative Example 4 | 12.5 | 2.5 | 4.20 | 13.7 | 27.7 | 93 | 80 |
| Comparative Example 5 | 5 | 1.0 | 4.28 | 12.1 | 28.8 | 79 | 88 |

As apparent from the results shown in Table 2, in Examples 1 to 8, the developer produced has high charge amount stability, and the true specific gravity can be arbitrarily controlled. On the other hand, in Comparative Examples 1 to 5, the charge amount stability of the developer produced is poor.

INDUSTRIAL APPLICABILITY

Due to a resin-filled ferrite carrier, the resin-filled ferrite carrier for an electrophotographic developer according to the present invention has a low specific gravity, can be reduced in the weight, is excellent in durability, making it possible to achieve life extension, has a high strength compared with a magnetic powder-dispersed carrier, and is free from breakage, deformation and fusion due to heat or impact. Furthermore, the correlation between the true specific gravity of a porous ferrite particle filled with a silicone resin (resin-filled ferrite carrier) and the amount of resin present in the surface is specified, whereby the developer produced can have high charge amount stability and the true specific gravity can be arbitrarily controlled.

Therefore, the resin-filled ferrite carrier core material and the ferrite carrier according to the present invention for an electrophotographic developer can be widely used in the field of, for example, a full-color machine requiring high image quality and a high-speed machine requiring reliability and durability in image preservation.

What is claimed is:

1. A resin-filled ferrite carrier for an electrophotographic developer, in which a void of a porous ferrite particle used as a ferrite carrier core material is filled with silicone resin, wherein a true specific gravity (Y) of the porous ferrite particle filled with the silicone resin and a Si/Fe value (X) measured by fluorescent X-ray elemental analysis satisfy the following inequality (1):

$$-350X \leq Y - 4.83 \leq -100X \quad (1); \text{ and}$$

wherein the true specific gravity (Y) of the porous ferrite particle filled with the silicone resin also satisfies the following inequality (2):

$$4.15 \text{ g/cm}^3 \leq Y \quad (2).$$

2. The resin-filled ferrite carrier according to claim 1, wherein the porous ferrite particle has a pore volume from 15 to 100 mm3/g and a peak pore diameter from 0.2 to 1.5 μm.

3. The resin-filled ferrite carrier according to claim 1, wherein the silicone resin is a room temperature-curable methylsilicone resin and contains an organic titanium-based catalyst and an aminosilane coupling agent.

4. The resin-filled ferrite carrier according to claim 1, wherein a surface of the ferrite carrier is coated with an acrylic resin.

5. An electrophotographic developer comprising:

the resin-filled ferrite carrier according to claim 1; and a toner.

6. The electrophotographic developer according to claim 5 which is used as a replenishment developer.

* * * * *